US006500272B2

(12) United States Patent
Cline et al.

(10) Patent No.: US 6,500,272 B2
(45) Date of Patent: Dec. 31, 2002

(54) SYSTEM FOR AND METHOD OF PURGING/ VENTING A BRUSH ARM BEARING

(75) Inventors: Scott R. Cline, Enosburg Falls, VT (US); Christopher E. Harvey, Jericho, VT (US); Willi O. Kalvaitis, West Chazy, NY (US); Davis H. Moquin, Plattsburgh, NY (US)

(73) Assignee: International Business Machines Corporation, Armonk, NY (US)

( * ) Notice: Subject to any disclaimer, the term of this patent is extended or adjusted under 35 U.S.C. 154(b) by 5 days.

(21) Appl. No.: 09/767,039

(22) Filed: Jan. 22, 2001

(65) Prior Publication Data

US 2002/0095740 A1 Jul. 25, 2002

(51) Int. Cl.[7] ..... B08B 5/04; A47L 5/14
(52) U.S. Cl. ..... 134/21; 15/301; 15/345
(58) Field of Search ..... 15/301, 376, 345; 134/21

(56) References Cited

U.S. PATENT DOCUMENTS

| | | | | | |
|---|---|---|---|---|---|
| 2,269,483 | A | * | 1/1942 | Replogle | 15/339 |
| 2,467,652 | A | * | 4/1949 | Beede | 15/339 |
| 2,568,466 | A | * | 9/1951 | Scott | 15/301 |
| 4,205,412 | A | * | 6/1980 | Weber | 15/345 |
| 4,300,261 | A | * | 11/1981 | Woodward et al. | 15/345 |
| 5,187,972 | A | | 2/1993 | DeFriez | 73/23.2 |
| 5,375,291 | A | | 12/1994 | Tateyama et al. | 15/302 |
| 5,487,376 | A | | 1/1996 | Yabe et al. | 600/121 |
| 5,577,293 | A | | 11/1996 | Meredith et al. | 15/302 |
| 5,634,236 | A | * | 6/1997 | Darsey | 15/345 |
| 5,834,642 | A | | 11/1998 | Decain et al. | 73/67.71 |
| 5,866,186 | A | | 2/1999 | Bazan | 426/506 |
| 5,974,868 | A | | 11/1999 | Decain et al. | 73/61.72 |
| 6,090,220 | A | | 7/2000 | Kim et al. | 134/21 |

* cited by examiner

*Primary Examiner*—Theresa T. Snider
(74) *Attorney, Agent, or Firm*—Downs Rachlin Martin PLLC

(57) ABSTRACT

A purge/vent system (10) for and method of purging/venting a brush arm bearing. The purge/vent system includes a driven mechanism (12) and a support member (14) having a first cavity (48) for containing the driven mechanism. A gas supply system (24) is in fluid communication with the first cavity proximate the upper end (18) of the driven mechanism, and an evacuation system (26) is in fluid communication with the first cavity proximate the lower end (20) of the driven mechanism. In operation, the gas supply system supplies a gas to the first chamber and the evacuation system draws the gas from the first chamber. As the evacuation system draws the gas from the first chamber, the gas is drawn across and/or through the driven mechanism to keep the driven mechanism dry and/or remove foreign material from the first chamber.

19 Claims, 3 Drawing Sheets

SYSTEM FOR AND METHOD OF PURGING/VENTING A BRUSH ARM BEARING

FIELD OF INVENTION

The present invention relates generally to the field of equipment maintenance. More particularly, the present invention is directed to a system for and method of purging/venting a rotational bearing of a semiconductor wafer-cleaning brush arm assembly to prevent foreign material from fouling the bearing.

BACKGROUND OF THE INVENTION

During the manufacturing of semiconductor devices, substrate wafers are subject to a number of processes that form multiple film layers upon one face of the wafer. These layers are made of one or more materials that, when arranged in a predetermined pattern, form parts of the microelectronic components of the devices. At various stages of wafer processing, the surface of the wafer must be polished to produce a uniformly smooth surface across the entire wafer. This polishing is typically accomplished by chemical mechanical polishing, a process that utilizes a chemical slurry in combination with a mechanical polisher to polish the wafer surface.

Immediately after polishing, the wafer is contaminated with the chemical slurry and other foreign material, such as particles removed from the surface of the wafer during polishing. Before the wafer can undergo further processing, e.g., deposition of another film layer, the wafer must be cleaned of the contaminants. Typically, the wafer is cleaned in a dedicated post-chemical mechanical polishing cleaning machine having a chamber for cleaning the backside of the wafer and a chamber for ultra-cleaning the processed surface of the wafer.

The processed surface cleaning chamber includes a rotating brush mounted on a brush arm. To clean the processed surface of the wafer, the wafer is mounted in a chuck within the cleaning chamber. The brush arm is then moved so that the rotating brush is brought into contact with the processed surface. The brush then makes several passes over the processed surface to remove the contaminants while de-ionized water is sprayed onto the wafer from a plurality of directions.

Generally, the brush arm comprises an elongate body having first and second ends spaced from one another. The rotating brush is located at the first end and a drive shaft for driving the rotating brush is located at the second end. The rotating brush is mounted in a first cavity at the first end of the brush arm via a rotational bearing. A drive belt extends between the drive shaft and the rotational bearing within a second cavity. The first and second cavities are prone to invasion by water and other foreign material from the ambient environment surrounding the brush arm through seals at the drive shaft and the rotational bearing. The first and second cavities are also prone to condensation problems from moist air trapped within them.

Moisture from water invasion and condensation frequently damages the bearings and may cause foreign material, such as particles from worn bearings, to be expelled out of the brush arm, contaminating the cleaning chamber. To avoid detrimental damage to the bearings and contamination of the cleaning chamber, the brush arm is typically changed relatively frequently. Frequent changing of the brush arm, however, causes extensive tool downtime, increases the chance of contaminating the cleaning chambers and increases tool operation and maintenance costs.

SUMMARY OF THE INVENTION

In one aspect, the present invention is directed to a system for purging/venting a driven mechanism with a gas, wherein the driven mechanism has a first portion and a second portion spaced from the first portion. The system comprises a support member for supporting the driven mechanism and defining a first cavity for containing the driven mechanism. The support member has a gas supply port for supplying the gas to the first cavity proximate the first portion of the driven mechanism and an evacuation port for removing the gas from the first cavity proximate the second portion of the driven mechanism. The support member is configured so that the gas does not drive the driven mechanism.

In another aspect, the present invention is directed to a method of purging/venting a driven mechanism located within a cavity of a support member, wherein the driven mechanism having a first portion and a second portion spaced from the first portion. The method comprises the steps of supplying a gas to the cavity proximate the first portion of the driven mechanism and evacuating the gas from the cavity proximate the second portion of the driven mechanism so that said gas does not drive the driven mechanism.

BRIEF DESCRIPTION OF THE DRAWING

For the purpose of illustrating the invention, the drawings show a form of the invention that is presently preferred. However, it should be understood that the present invention is not limited to the precise arrangements and instrumentalities shown in the drawings.

DETAILED DESCRIPTION OF THE INVENTION

Figure 1:
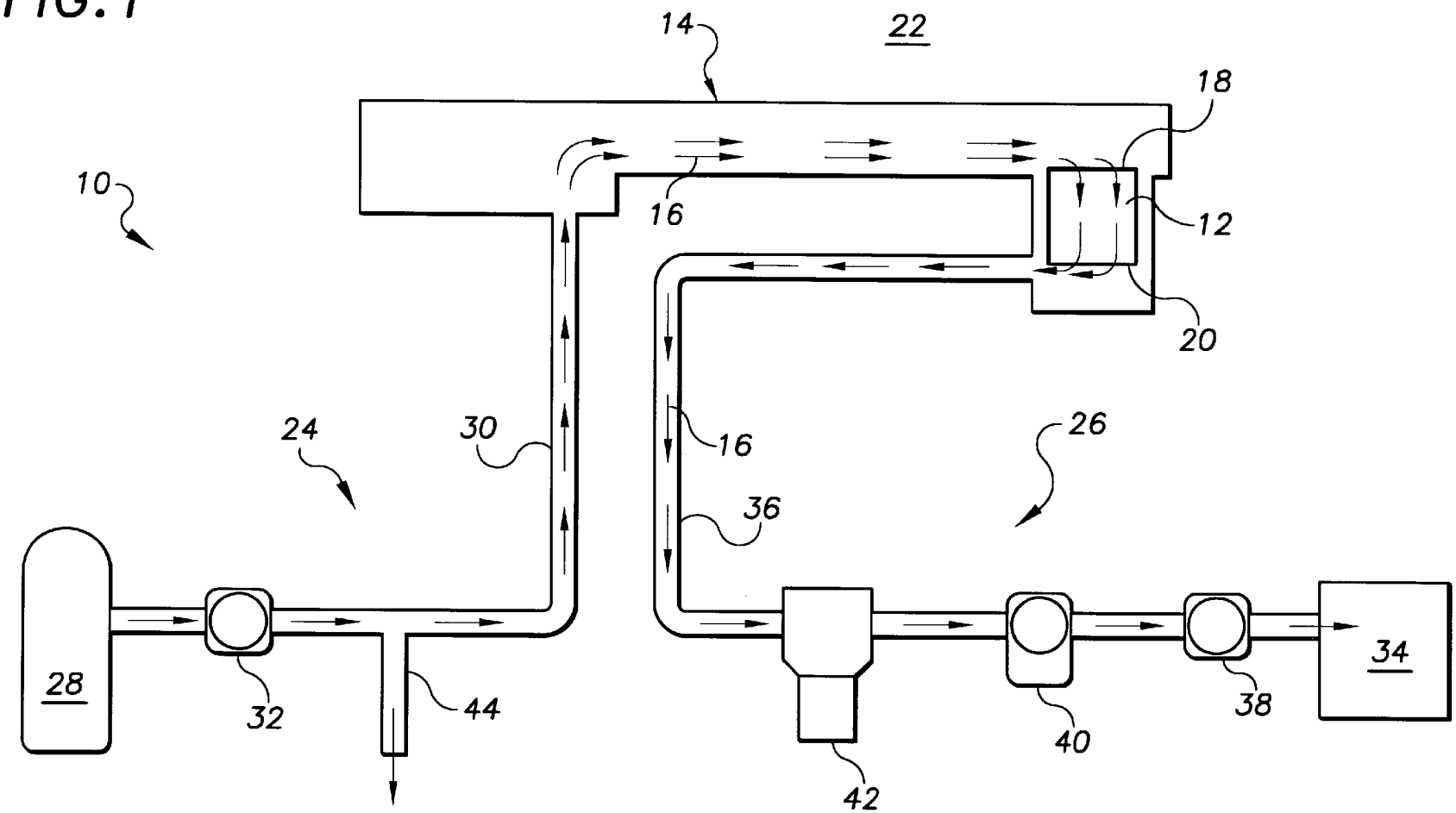
FIG. 1 is a schematic view of a purge/vent system according to the present invention.

Referring now to the drawings, wherein like numerals indicate like elements, FIG. 1 shows in accordance with the present invention a purge/vent system, which is indicated generally by the numeral 10. Purge/vent system 10 includes a driven mechanism 12 engaged with and supported by a support member 14. Purge/vent system 10 supplies a gas (the direction of gas flow being indicated by arrows 16) adjacent the upper end 18 of driven mechanism 12 and draws the gas away from the driven mechanism adjacent the lower end 20 of the driven mechanism. In this manner, driven mechanism 12 may be kept free of foreign material, such as moisture and other contaminants from the ambient environment 22 surrounding support member 14, by evacuating foreign material from inside the support member and particularly from in and/or around the driven mechanism. In addition, depending upon the application, purge/vent system 10 can prevent condensation within support member 14 by supplying a gas, such as air, at a predetermined temperature, that is above the temperature at which condensation would otherwise occur.

In the embodiment illustrated, purge/vent system 10 is adapted for use with a semiconductor wafer cleaning machine (not shown), such as post-chemical mechanical polishing cleaner model no. SP-W813-AS, available from Dainippon Screen Manufacturing Company, Ltd., Kyoto, Japan. Accordingly, driven mechanism 12 shown is a rotational bearing for supporting a rotatable brush (not shown) and support member 14 shown is a brush arm. However, purge/vent system 10 of the present invention may be used with other types of equipment, such as drill presses, circular and reciprocating saws, among others, having driven mechanisms that may be subject to contaminants from the ambient operating environment surrounding the drive mechanisms and/or contaminants from within the support member. In this connection, driven mechanism 12 may be a rotating bearing, an electric motor or a reciprocating mechanism, among others, and support member 14 may be any member capable of supporting and at least partially housing the driven mechanism, such as a motor and/or bearing housing or a tool support armature.

Purge/vent system 10 further includes a gas supply system 24 and an evacuation system 26. Gas supply system 24 comprises a gas source 28, such as a compressor or a pressurized storage tank, among others, for supplying gas to the driven mechanism 12. Preferably, the gas is air that has been dried to remove substantially all moisture in the air. However, another gas, e.g., another drying gas such as nitrogen or a chlorofluorocarbon, among others, may be used. The gas flows from gas source 28 to support member 14 through a supply conduit 30. The pressure and flow of gas may be controlled by a regulator 32 located in supply conduit 30, which may be any suitable conduit, such as plastic or metal tubing. One skilled in the art will recognize that regulator 32 may be part of gas source 28 or may be located at any location between the gas source and driven mechanism 12.

Evacuation system 26 includes a vacuum source 34, such as a vacuum pump or a chamber having an internal pressure lower than the pressure of the gas at driven mechanism 12, among others, for drawing the gas supplied from gas source 28 across and/or through the driven mechanism. The gas flows from support member 14 to vacuum source 34 through a vacuum conduit 36, which may be any suitable conduit, such as plastic or metal tubing. Preferably, the tubing is made of a translucent material, such a polycarbonate plastic, to aid visual inspection of the contents of the gas evacuated from support member 14. Evacuation system 26 may further include a regulator 38 located in vacuum conduit 36 for regulating the pressure and flow of the gas through the evacuation system. One skilled in the art will recognize that regulator 38 may be part of vacuum source 34 or may be located at any location between driven mechanism 12 and the vacuum source.

Evacuation system 26 preferably includes a flow meter 40 for measuring the gas flow through purge/vent system 10. One skilled in the art will recognize that flow meter 40 may be any flow meter suitable for measuring the anticipated flow through purge/vent system 10. In a preferred embodiment, evacuation system 26 also includes a monitoring device 42 for monitoring the contents of the gas drawn away from driven mechanism 12 by the evacuation system to determine whether or not any foreign material is present in the evacuated gas. In one embodiment, monitoring device 42 is a glass trap that allows a human operator to visually inspect its contents for the presence of foreign material captured thereby. Supply conduit 30 may optionally include a vent 44 for venting excess gas not drawn away from driven mechanism 12 by evacuation system 26. If the gas supplied by gas source 28 is air, vent 44 may vent the excess air to ambient environment 22. Otherwise, the excess gas may be captured, e.g., in a storage tank (not shown).

In a preferred embodiment, regulator 32 of gas supply system 24 and regulator 38 of evacuation system 26 are adjusted so that the pressure within support member 14 is generally neutral or slightly negative, i.e., the pressure within the support member is generally equal to or less than the pressure of ambient environment 22 surrounding the support member. When the pressure is neutral, water and/or other contaminants generally will not infiltrate into support member 14 from ambient environment 22, and, conversely, foreign material inside the support member generally will not be forced into the ambient environment. Similarly, a slight negative pressure relative to the pressure in ambient environment 22 will prevent foreign material present inside support member 14 from being forced into the ambient environment. Although it is desirable to maintain a generally neutral or negative pressure within support member 14, support member may contain a positive pressure relative to the pressure in ambient environment 22.

If a positive pressure within support member 14 is desired, vacuum source 34 may be eliminated and replaced with a collection tank if the gas must be collected or may be vented to ambient environment 22 if air is used. If a negative pressure is desired and the gas used is ambient air, gas supply system 24 may be eliminated. One skilled in the art will recognize the various arrangements of gas supply system 24 and evacuation system 26 that may be made in accordance with the present invention depending upon the desired pressure within support member 14.

Figure 2:
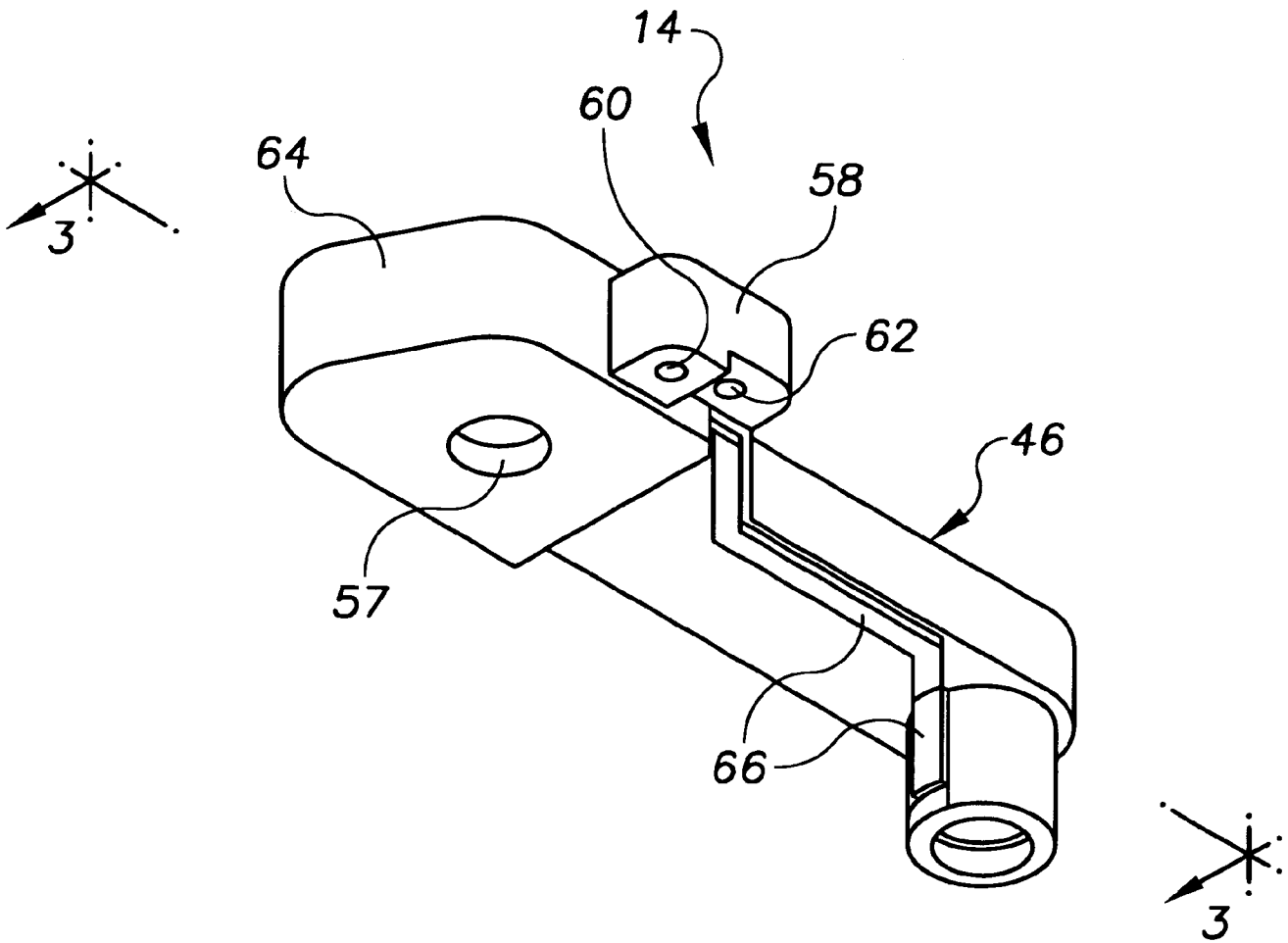
FIG. 2 is an isometric view of one embodiment of a brush arm according to the present invention usable with the purge/vent system of FIG. 1.
Figure 3:
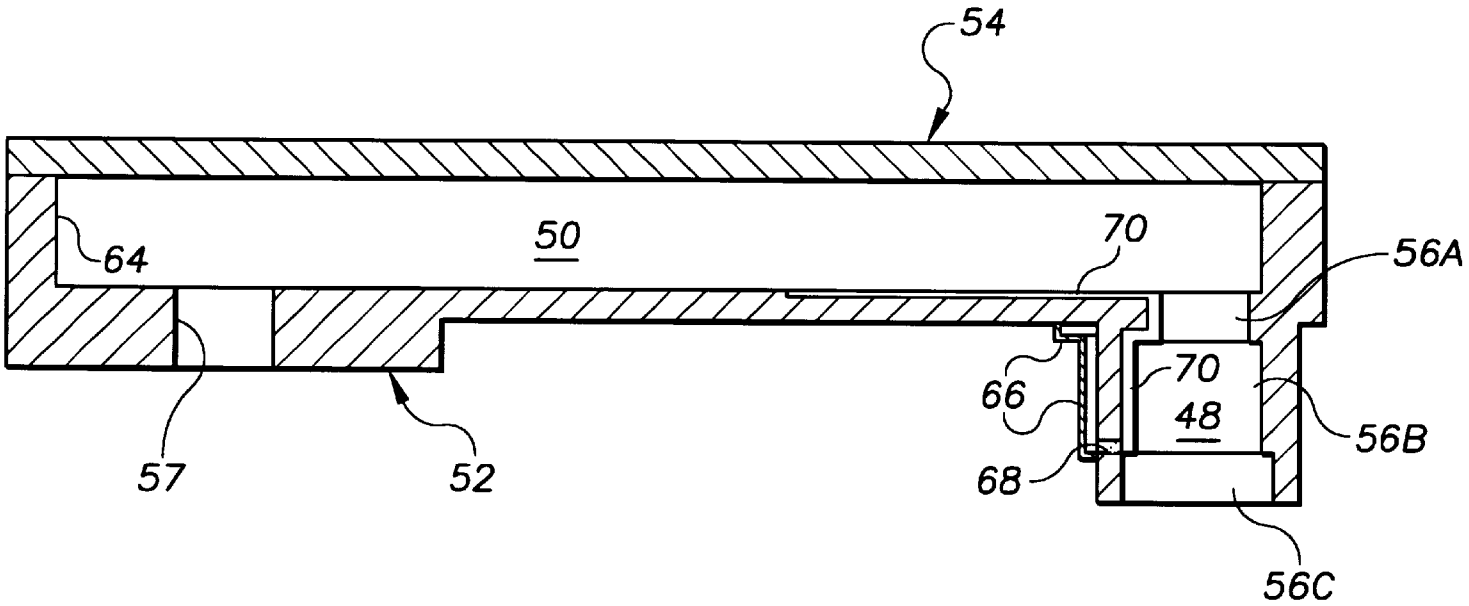
FIG. 3 is an enlarged cross-sectional view of the brush arm as taken along line 3—3 of FIG. 2.

FIGS. 2 and 3 show a particular embodiment of support member 14 that is presently preferred. An mentioned above, this embodiment is a brush arm of a wafer cleaning machine (not shown). Support member 14 comprises an elongate body 46 that forms a first cavity 48 and a second cavity 50. Body 46 includes a lower member 52 and an upper member 54 that may be removably secured to the lower member, e.g., by threaded fasteners (not shown), for accessing first cavity 48 and second cavity 50. However, one skilled in the art will recognize that upper member 54 may be secured to lower member 52 by any of a number of means, such as welding, adhesive bonding or clips, among others. Lower member 52 and upper member 54 may be made of any suitable material, such as metal, plastic or a combination of metal and plastic, among others.

First cavity 48 receives a driven mechanism (not shown), such as a rotational bearing for driving a rotatable tool (not shown), e.g., a rotatable brush. First cavity 48 generally comprises three generally cylindrical portions 56A–C having diameters different from one another. First cavity 48 opens into second cavity 50, which generally extends along the length of body 46 and contains, e.g., a drive belt (not shown) and a sheave (not shown) for driving driven mechanism 12 and thus the rotatable tool. Lower member 52 includes an aperture 57 that receives a drive shaft (not shown) for driving the driven mechanism 12.

Support member 14 further includes a connection block 58 having a gas supply port and evacuation port 62 for connecting the support member to gas supply system 24 and evacuation system 26 of FIG. 1, respectively. Connection block 58 may be molded integrally with lower member 52 or may be formed separately and attached to the lower member by, e.g., welding, adhesive bonding or mechanical fasteners. In addition, connection block 58 may be located elsewhere on support member 14 or may be eliminated, in which case gas supply system 24 and evacuation system 26 may be connected, respectively, to a gas supply port located on body 46 upstream of the driven mechanism and an evacuation port located generally downstream of the driven mechanism.

Gas supply port 60 is in fluid communication with second cavity 50 via an aperture (not shown) in sidewall 64 of lower member 52. Evacuation port 62 is in fluid communication with a vacuum conduit 66 formed by a generally C-shaped channel hermetically secured to lower member 52, e.g., by welding. Vacuum conduit 66 is in fluid communication with first cavity 48 via an aperture 68 in lower member 52. To aid the collection of foreign material within support member and to aid the flow of gas and any collected foreign material through first cavity 48, which in operation would be substantially filled with a driven mechanism, a groove 70 is provided in a portion of second cavity 50 and in cylindrical portions 56A, 56B of the first cavity 48.

In operation, gas, e.g., from gas supply system 24 of FIG. 1, flows into second cavity 50 through gas supply port 60, and evacuation port 62 is in fluid communication with an evacuation system, such as evacuation system 26 of FIG. 1. Evacuation system 26 draws the gas supplied via gas supply port 60 through second cavity 50 and through at least a portion of first cavity 48, which contains a driven mechanism. Foreign material that may be present in second cavity 50 can flow into the portion of groove 70 within the second cavity, then into the portion of groove 70 within first cavity 48 and then out of the first cavity via aperture 68. As evacuation system 26 evacuates the gas from first cavity 48, the gas is drawn across and/or through the driven mechanism, keeping it dry and removing any foreign material that may be present within the first cavity. The portion of groove 70 at cylindrical portions 56A, 56B of first cavity 48 also aids the collection and removal of foreign material from the first cavity.

Although the structure and function of support member 14 have been described with respect to a particular brush arm embodiment, one skilled in the art will appreciate the numerous and diverse forms support member 14 may have, a few of which have been mentioned above.

While the present invention has been described in connection with a preferred embodiment, it will be understood that it is not so limited. On the contrary, it is intended to cover all alternatives, modifications and equivalents as may be included within the spirit and scope of the invention as defined in the appended claims.

What is claimed is:

1. A system for preventing foreign material formation on a rotational bearing with a gas, the rotational bearing having a first portion and a second portion spaced from the first portion, the system comprising:

a. a support member for supporting the rotational bearing and defining a first cavity for containing the rotational bearing, said support member having:

i. a gas supply port for supplying the gas to said first cavity proximate the first portion of the rotational bearing; and ii. an evacuation port for evacuating the gas from said first cavity proximate the second portion of the rotational bearing;

b. wherein said support member is configured so that the gas does not drive the rotational bearing.

2. The system according to claim 1, wherein said support member is a brush arm.

3. The system according to claim 1, wherein said support member defines a second cavity in fluid communication with said first cavity, said gas supply port being in fluid communication with said second cavity and said evacuation port being in fluid communication with said first cavity.

4. The system according to claim 1, further comprising a gas delivery system that includes a gas source and a gas supply conduit, said gas source in fluid communication with said gas supply port via said gas supply conduit.

5. The system according to claim 4, wherein the gas delivery system further comprises a vent for venting excess gas from the gas delivery system.

6. The system according to claim 4, further comprising an evacuation system that includes a vacuum source and a vacuum conduit, said vacuum source in fluid communication with said evacuation port via said vacuum conduit.

7. The system according to claim 6, wherein said evacuation system further comprises a monitoring device for monitoring contents of the evacuated gas.

8. The system according to claim 7, wherein said monitoring device is a trap that allows for visual inspection of foreign material trapped in said trap.

9. The system according to claim 1, further comprising an evacuation system that includes a vacuum source and a vacuum conduit, said vacuum source in fluid communication with said evacuation port via said vacuum conduit.

10. The system according to claim 9, wherein said evacuation system further comprises a regulator for regulating the pressure in said evacuation system.

11. A cleaning system comprising:

a. a support member defining a cavity, said support member for supporting a rotatable cleaning tool;

b. a rotational bearing for allowing rotation of the cleaning tool, said rotational bearing disposed in said cavity and having a first portion and a second portion spaced from said first portion;

c. a gas supply pot for supplying a gas to said cavity, said gas supply port in fluid communication with said cavity proximate said first portion of said rotational bearing; and d. an evacuation port for evacuating the gas from said cavity, said evacuation port in fluid communication with said cavity proximate said second portion of said rotational bearing;

e. wherein said support member is configured so that the gas does not drive the rotatable cleaning tool.

12. The cleaning system according to claim 11, further comprising an evacuation system external to said cavity and fluidly coupled to said evacuation port.

13. The cleaning system according to claim 11, further comprising a monitoring device fluidly coupled to said evacuation port for monitoring contents of the gas evacuated from said cavity.

14. The cleaning system according to claim 11, wherein the rotatable cleaning tool is a wafer cleaning brush.

15. The cleaning system according to claim 11, further comprising a gas supply system external to said cavity and in fluid communication with said gas supply port.

16. The cleaning system according to claim 11, wherein the gas comprises dry air.

17. A method for preventing foreign material formation on a rotational bearing comprising the steps of:

a. providing the rotational bearing located within a cavity of a support member, the rotational bearing having a first portion and a second portion spaced from the first portion;

b. supplying a gas to the cavity proximate the first portion of the rotational bearing; and c. evacuating said gas from the cavity proximate the second portion of the rotational bearing in a manner such that said gas does not drive the rotational bearing;

d. wherein foreign material is prevented from forming on the rotational bearing.

18. The method according to claim 17, wherein said gas is supplied using a gas supply system and evacuated using an evacuation system and the support member has an exterior surface exposed to an ambient pressure, the method further comprising:

e. adjusting at least one of said gas supply system and said evacuation system so that the gas in the cavity has a pressure no greater than said ambient pressure.

19. The method according to claim 17, further comprising the step of monitoring the contents of said gas evacuated from said cavity for the presence of foreign material.

* * * * *